US005095468A

United States Patent [19]

Sato

[11] Patent Number: 5,095,468

[45] Date of Patent: Mar. 10, 1992

[54] ALARM CLOCK

[75] Inventor: Seiichi Sato, Tokyo, Japan

[73] Assignee: Tomy Company, Ltd., Tokyo, Japan

[21] Appl. No.: 732,180

[22] Filed: Jul. 18, 1991

[30] Foreign Application Priority Data

Aug. 10, 1990 [JP] Japan ..... 2-213299

[51] Int. Cl.[5] ..... G04B 23/02

[52] U.S. Cl. ..... 368/72; 368/262

[58] Field of Search ..... 368/72-74, 368/243-244, 250, 254, 262-263

[56] References Cited

U.S. PATENT DOCUMENTS 4,316,273 2/1982 Jetter ..... 368/262
4,352,170 9/1982 Jetter ..... 368/73
4,352,171 9/1982 Jetter ..... 368/262
4,430,006 2/1984 Jetter ..... 368/73
4,456,157 1/1984 Jetter ..... 368/73

FOREIGN PATENT DOCUMENTS 61-288194 6/1965 Japan ..... 368/262

*Primary Examiner*—Vit W. Miska
*Attorney, Agent, or Firm*—Staas & Halsey

[57] ABSTRACT

An alarm clock in which, in order to turnoff an alarm, a predetermined number of striking objects must be struck. The striking objects appear and disappear out of and into holes in a top portion of a housing. An effective strike is not generated until the striking object is hit when it is fully extended. The striking objects are not always fully extended because of dummy cams employed along with complete cams for moving the striking objects into and out of the holes. The alarm clock can also be used as a game by turning on a switch which bypasses the alarm clock function.

8 Claims, 8 Drawing Sheets

ALARM CLOCK

BACKGROUND OF THE INVENTION

This invention is directed to an alarm clock which also functions as a game.

1. Field of the Invention

Alarm clocks are constructed such that when a predetermined alarm time occurs, an alarm sound is generated at the time. However, when a user of an alarm clock wants to sleep, the user unconsciously depresses an alarm stop switch, and the user is not awakened at the predetermined time.

2. Description of the Prior Art

In order to solve this problem, an alarm clock has been proposed which is constructed such that the alarm sound gradually increases in magnitude. The same problem as above-mentioned arises, however, if the alarm stop switch is depressed after the sound becomes loud, the user is not awakened at the predetermined time because the alarm has been turned off.

SUMMARY OF THE INVENTION

It is an object of the present invention to provide an alarm clock with which a user can wake up without fail.

It is another object of the present invention to provide an alarm clock which also functions as a game.

The present invention achieves the above-mentioned object by providing an alarm clock which includes timer means for setting an alarm time and alarm sound generating means for generating an alarm sound to notify a user of the arrival of the alarm time. The present invention comprises striking objects mounted in the housing of the alarm clock which appear and disappear out of and into the housing of the alarm clock, cam mechanism means for causing the striking object to appear and disappear, effective strike detecting means for detecting whether a striking object projected from the opening has been struck at a proper timing, counting means for counting a number of times the striking objects are struck at proper timings, and controlling means for driving the cam mechanism and the alarm sound generating means when the alarm time set by the timer means occur and for stopping driving of the cam mechanism means and the alarm sound generating means when the counting means reaches a predetermined count number.

According to the present invention described above, when an alarm time occurs, a condition is realized such that the alarm sound generating means generates an alarm sound and the cam mechanism is driven so that the striking objects appear and disappear at suitable timings by way of the openings provided in the housing of the alarm clock. To stop the alarm sound during this condition, a striking object projected an opening at a predetermined timing must be struck. This must be performed a predetermined number of times. Accordingly, since the alarm sound continues to sound until the person who has been asleep strikes the striking objects a predetermined number of times, the person will be awakened by the alarm sound. Meanwhile, since it is necessary to ascertain appearing and disappering striking objects and strike the striking objects at a proper timing a predetermined number of times to stop gerernation of the alarm sound, a person must be throughly accurate such striking operation. Accordingly, with the alarm clock of the present invention, a person can wake up at the preset alarm time without fail.

DESCRIPTION OF THE PREFERRED EMBODIMENT

Figure 1:
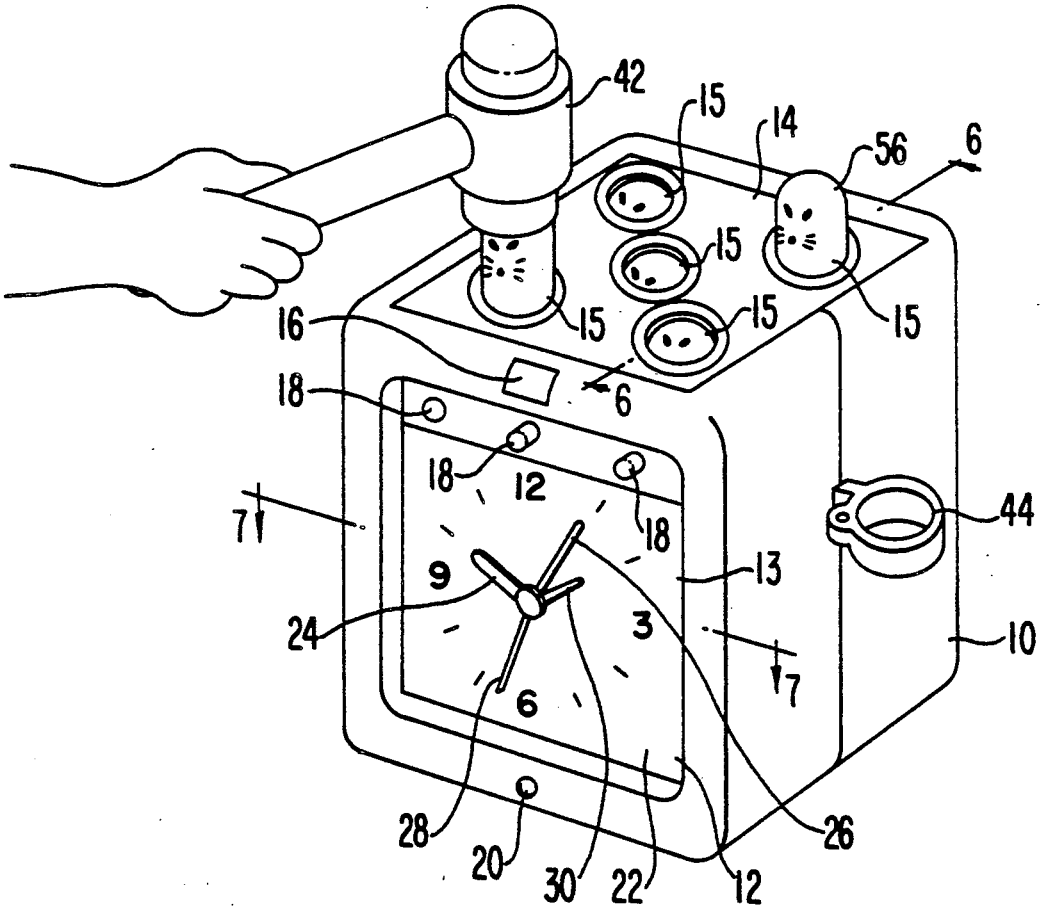
FIG. 1 is a perspective view of an alarm clock according to the present invention.

An embodiment of an alarm clock according to the present invention will be described with reference to the drawings. First, a construction of the present invention will be described with respect to FIG. 1 which is perspective view of an alarm clock.

The alarm clock of the present invention has a substantially cubic profile. A time indicating section 13 provided on a front face 12 of the alarm clock while a game section 14 is provided on a top face of the alarm clock.

A game selecting switch 16 of the depressing and returing type is provided substantially at the corner of an upper end of the front face 12 of a housing 10 which forms the alarm clock. The alarm clock is formed such that if the game selecting switch 16 is operated, then a mole striking game can be played independently of a set alarm time. Three effective strike indicating LEDs 18 are provided in a horizontal row above the time indicating section 13 and below the game selecting switch 16. A sound outlet opening 20 for a speaker, providing a sound indicating an effective strike is provided below the time indicating section 13.

The time indicating section 13 has a construction similar to that of a normal clock and has an hour hand 24, a minute hand 26, a second hand 28 and an alarm time setting hand 30 provided on a dial 22.

Five circular openings 15 are provided in the mole striking game section 14. The mole body portions 56 are disposed in each of the openings 15 which permit upward and downward movement of the mole body portions 56 therethrough.

Reference numeral 42 denotes a hammer for striking the mole body portions 56. The hammer 42 is supported with a shank portion thereof inserted in a holder 44 provided on a side face of the housing 10. When a set alarm time occurs, an alarm sound is generated and the mole body portions 56 randomly appear and disappear through the openings 15 at the game section 14. The alarm clock stops the alarm from sounding when the mole body portions 56 projected from the openings 15 are struck a perdetermined number of times. Effective strike indicating LEDs 18 indicate a number of mole body portions 56 that have been effectively struck.

Figure 2:
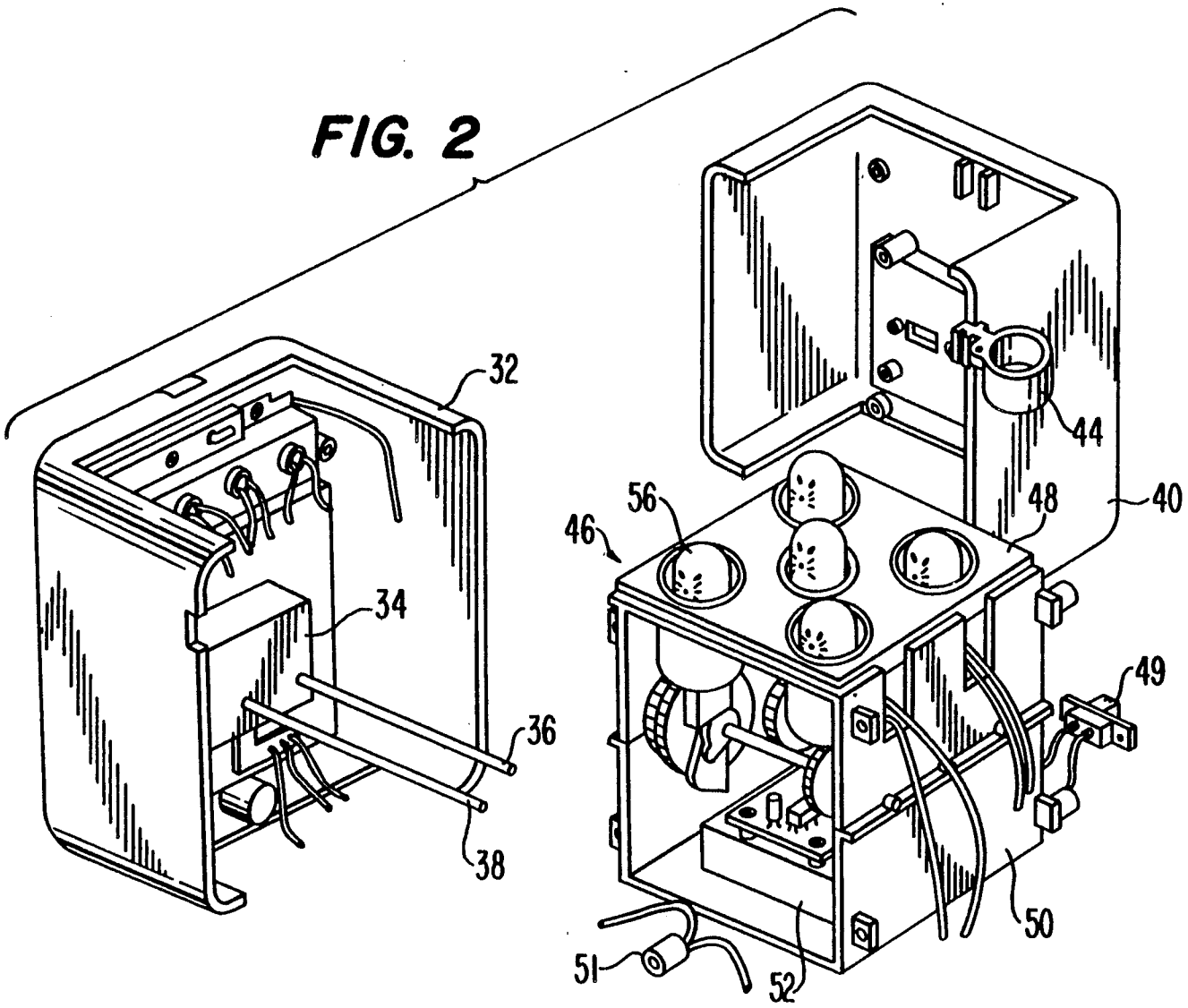
FIG. 2 is a fragmentary perspective view of the alarm clock according to the present invention.

FIG. 2 is a fragmentary perspective view of the alarm clock according to the present invention. The housing 10 of the alarm clock includes a front frame 32 and a rear frame 40. A clock unit 34 of the time indicating section 13 is provided on the inner side of the front frame 32. A time setting shaft 36 and an alarm time setting shaft 38 extend rearwardly from the clock unit 34 such that they project from the rear frame 40. Meanwhile, the holder 44 into which a shank portion of the hammer 42 can be inserted is held between joining portions of the front frame 32 and rear frame 40. A body chassis 46 in which a mechanical construction of the mole striking game section 14 and a controlling circuit 52 are accommodated is located between the front frame 32 and rear frame 40.

A mole striking face plate 48 is provided at an upper face of the body chassis 46. The openings 15 in which the moles 56 appear and disppear therethrough are provided in the face plate 48 as described above. Round shafts on which cams are fixedly or loosely mounted are supported on a side 50 of the body chassis 46. A controlling circuit unit 52 for the mole striking game is fixedly mounted on a lower face of the body chassis 46. A speaker 51 for generating a sound effect is provided at a position corresponding to the sound outlet opening 20 for the speaker on the inner side of the front frame 32. A clock alarm switch 49 for rendering the setting of the alarm clock ineffective is provided at a lower portion of the rear frame 40.

Figure 3:
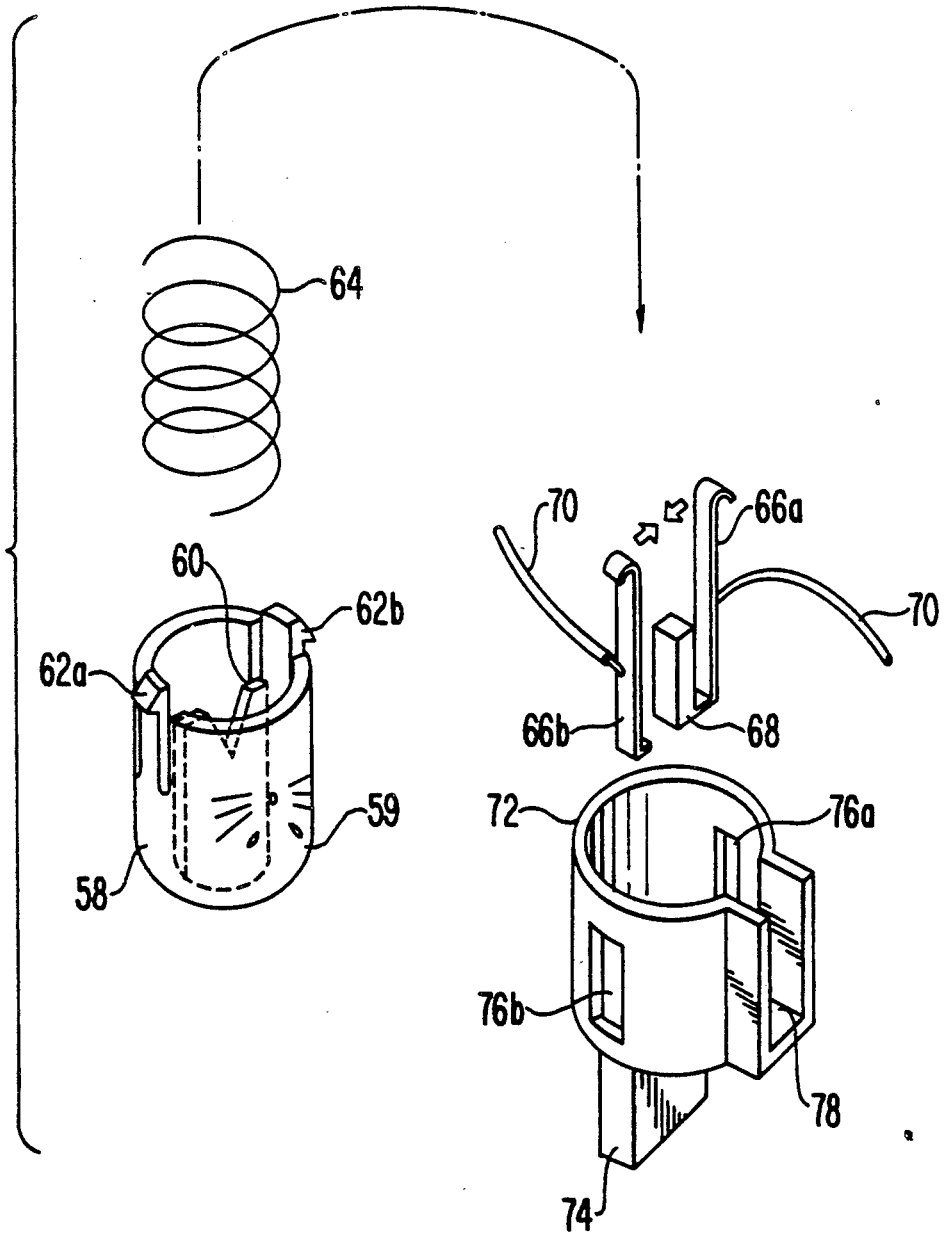
FIG. 3 is a fragmentary view of a mole body portion used as a striking object in the alarm clock according to the present invention.
Figure 4:
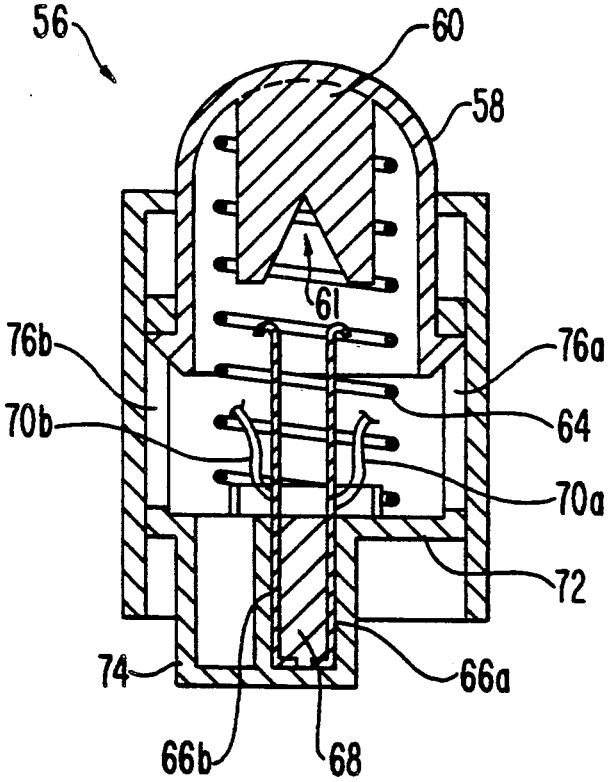
FIG. 4 is a cross-sectional view of the mole body portion shown in FIG. 3.

FIG. 3 is a fragmentary view of a mounting structure for a striking object, for example, the mole body portions 56. FIG. 4 is a cross-sectional view of a mole body portion 56.

The mole body portion 56, serving as a striking object, includes a mole head 58 having a mark 59 of the face of a mole drawn on an outer periphery thereof, a spring 64, contact pieces 66*a* and 66*b*, and a follower body 72.

The mole head 58 has an outer profile forming a cylinder cap, and a projection plate 60 in the form of a flat face having a V-shaped groove formed at an end thereof provided vertically at the center of the inside of the mole head 58. A pair of resilient engaging projections 62*a* and 62*b* are formed at opposing locations on a outer peripheral side face of the mole head 58. The spring 64 is disposed such that it surrounds the V-shaped projection plate 60. One end of the spring 64 is held in contact with the base of the V-shaped projection plate 60 while the other end is held in contact with a lower portion of the follower body 72.

The contact pieces 66*a* and 66*b* are each formed from a resilient conductive thin metal plate and each has a structure wherein a first end is rounded and bent in an outer direction away from the interior of the follower body 72 and a second end is bent in an inner direction toward the interior of the follower body 72. Connecting lead wires 70*a* and 70*b* extend from predetermined locations of the contact pieces 66*a* and 66*b*, respectively. The connecting lead wires 70*a* and 70*b* are led out of the follower body 72 through a cutaway portion 78 provided in the follower body 72.

A cam conacting projection 74 is provided on a lower face of the follower body 72 on which the mole head 58 is seated. Rectangular guide openings 76*a* and 76*b* engage the engaging projections 62*a* and 62*b* and guide the upward and downward movement of the mole head 58. Cutaway portions 78 are provided in a side face of the mole head 58 through which the connecting lead wires 70*a* and 70*b* are lead out. The cam contacting projection 74 has, at a portion of the inside thereof, a spacing in which lower portions of the contact pieces 66*a* and 66*b* are accommodated. Lower portions of the contact pieces 66*a* and 66*b* are fitted and fixed in the spacing together with a fixing member 68.

When the mole head 58, spring 64, contact pieces 66*a* and 66*b* and follower body 72 are integrated with each other, the mole head 58 is in a condition wherein a lifting force is always applied to the mole head 58 due to a resilient force of the spring 64. The lifting movement is stopped as the engaging projections 62*a* and 62*b* of the mole head 58 are arrested by upper ends of the rectangular guide openings 76*a* and 76*b*. If the mole head 58 is stuck at an upper extension thereof by the hammer 42, the mole head 58 may be moved downwardly, depending upon which one of the striking force and the resilient force of the spring 64 is greater or smaller, until ends of the contact pieces 66*a* and 66*b* are contacted with the V-shaped groove 61 of the mole head 58. A striking force of the hammer 52 is applied to the mole head 58. When the mole head 58 and the follower body 72 are sufficiently moved upwardly (condition wherein the engaging projections 62*a* and 62*b* of the mole head 58 are arrested by the upper ends of the rectangular guide openings 75*a* and 76*b*) by rotation of a complete cam which will be hereinafter described, the mole head 58 is moved down sufficiently so that the contact pieces 66*a* and 66*b* reach the bottom of the V-shaped groove 61 in a condition wherein the ends thereof are held in contact with the V-shaped groove 61 and the ends of the contact pieces 66*a* and 66*b* contacts each other. Consequently, electric current will flow between the two contact pieces.

On the other hand, when a complete cam does not lift the mole head 58 sufficiently or when a dummy cam, which will be described hereinafter, moves the mole head 58 upwardly, even if the mole head 58 is struck by the hammer 42 since the stroke of the downward movement of the mole head 58 is short, no electric current will flow between the two contact pieces 66*a* and 66*b*, and an effective strike will not register.

Figure 5:
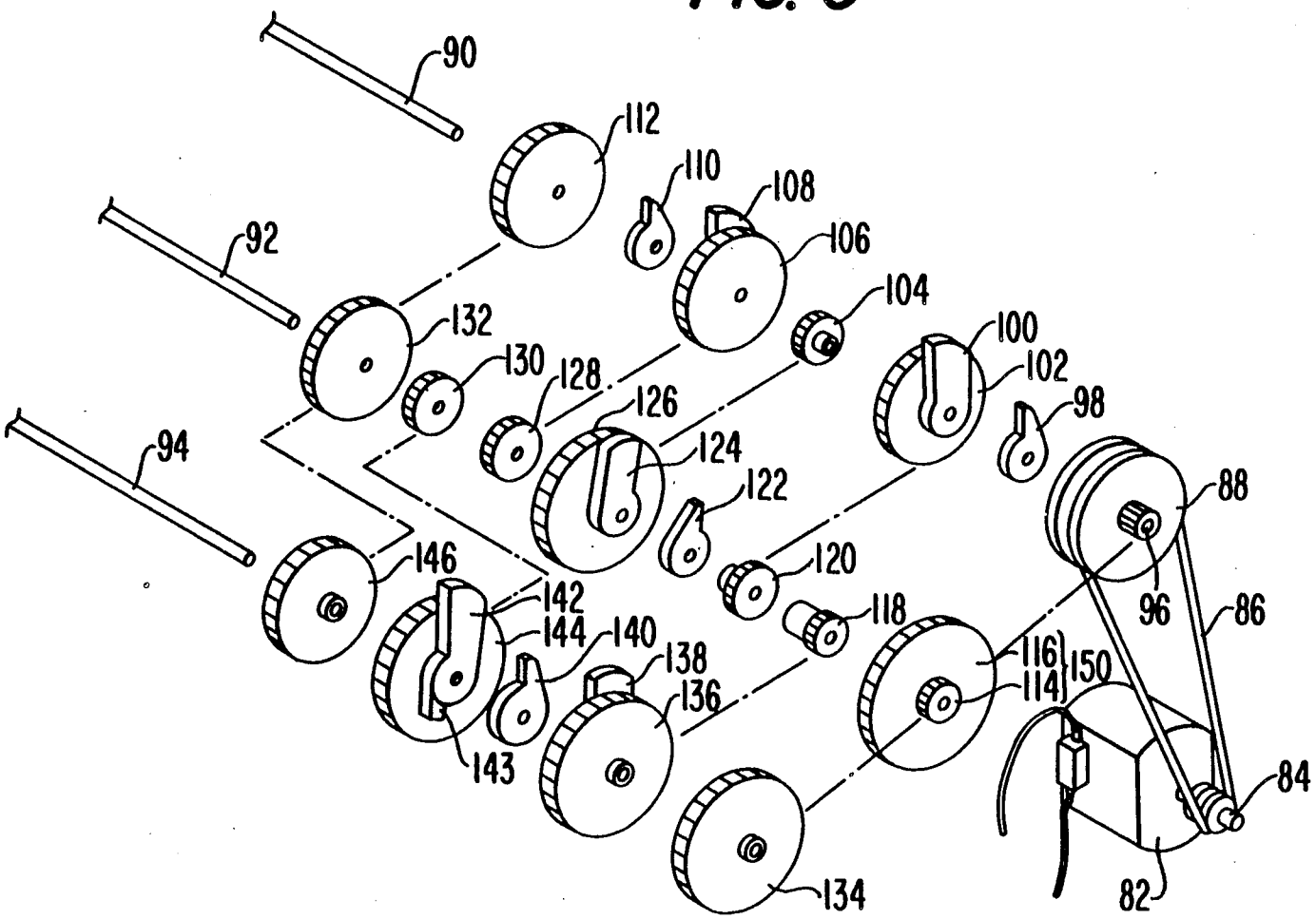
FIG. 5 is a fragmentary perspective view of a cam mechanism for moving the mole body portion up and down.
Figure 7:
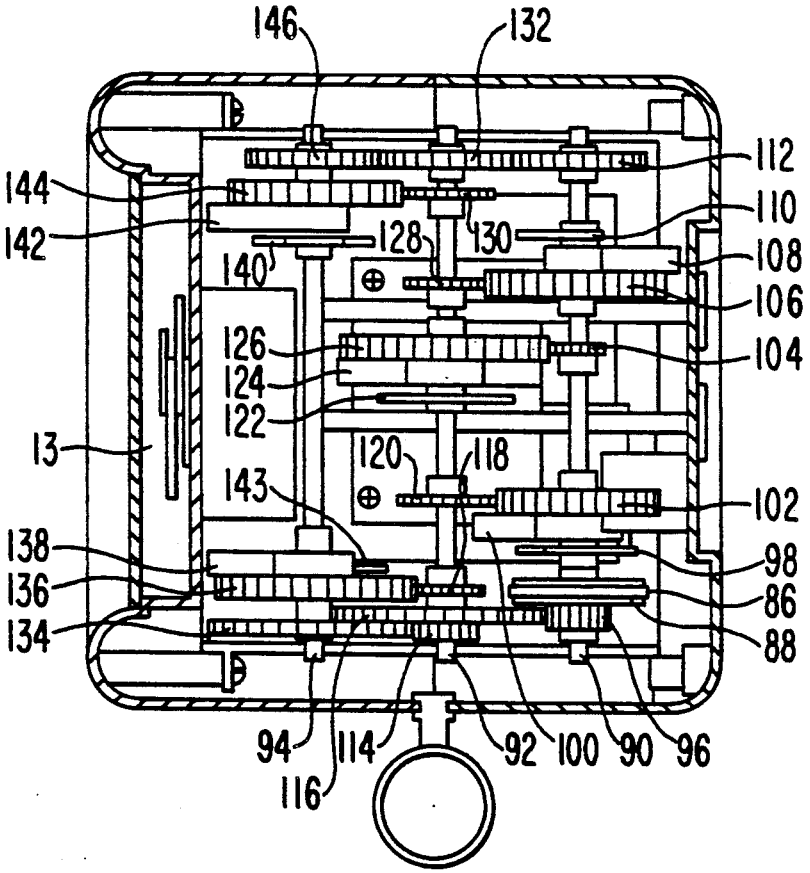
FIG. 7 is a cross-sectional top view of the cam mechanism as viewed from above (a sectional view taken along line II—II of FIG. 1)

FIG. 5 is a fragmentary perspective view of a cam mechanism for moving the mole body portions 56 upwardly and downwardly. FIG. 7 is a top view of the cam mechanism (a sectional view taken along line II—II of FIG. 1).

As shown in FIG. 5, the cam mechanism comprises a motor 82 serving as a power source, a motor shaft 84, a rotation transmitting belt 86, a pulley 88 for receiving a first rotational force the motor 82 through the motor shaft 84, three round shafts 90, 92 and 94, and cams and spur gears fixedly or loosely mounted on the round shafts. The cams are divided into two types: a first type which is a complete cam which can move a mole head 58 to its upper limit; the second type which is a dummy cam which can move a mole head 58 upwardly to a certain degree. In FIG. 5, reference numerals 100, 108, 124, 138 and 142 each denote a complete cam, and reference numerals 98, 110, 122 140 and 143 each denote a dummy cam.

The spur gears 102, 106, 126, 136 and 144 correspond to the positions of the five mole openings 15 described hereinabove and are fixedly mounted in an integrated condition on the complete cams 100, 108, 124, 138 and 142, respectively. The mutually integrated spur gears and complete cams are loosely fitted in a condition free from rotation of the shafts. It should be noted that the pulley 88 and spur gear 96 are fixedly mounted in an integration condition and they are loosely fixed in a free condition on the round shaft 90. Meanwhile, the spur gear 114 and the spur gear 116 are fixedly mounted in an integrated condition. The speed reducing gear 150 is loosely fitted in a free condition on the round shaft 92. The other spur gears and dummy cams are all fixedly mounted in an integrated relationship on the shafts. It should be noted that the arranged locations of the dummy cams are next to the complete cams integrated therewith. Consequently, the cam mechanism is such that not only the complete cams but also the dummy cams are contacted with the cam contacting projections 74 provided on the lower faces of the follower bodies 72.

On the round shaft 90, the spur gear 96, pulley 88, dummy cam 98, complete cam 100, spur gears 102, 104, and 106, complete cam 108, dummy cam 110 and spur gear 113 are fitted in this order in a direction from the motor toward the round shaft 90 as shown in FIG. 5. Meanwhile, on the round shaft 92, the speed reducing gear 150 (spur gear 114 and 116), spur gear 118 and 120, dummy cam 122, complete cam 124, spur gears 126, 128, 130 and 132 are fitted in this order in a direction from the motor toward the round shaft 92 as shown in FIG. 5. Meanwhile, on the round shaft 94, the spur gear 134, 136, complete cam 138, dummy cam 140, complete cam 142 (dummy cam 143), spur gear 144 and spur gear 146 are fitted in a direction from the motor toward round shaft 92 as shown in FIG. 5.

The gears on the round shaft 90 and round shaft 92, and the spur gears 96, 116, 102, 120, 104, 126, 106, 128, 112 and 132 are held in meshing engagement with each other. The gears on the round shaft 92 and 94, and the spur gears 114, 134, 118, 136, 130, 144, 132 and 146 are held in meshing engagement with each other.

Since the cam mechanism is constructed in such a manner as described above, the motor 82 is rotated and a rotational force transmitted to the pulley 88 by way of the motor shaft 84 and belt 86 is transmitted to the spur gear 116 of the speed reducing gear 150 by way of the spur gear 96. Power is similarly transmitted to the spur gear 134 by way of the spur gear 114 to the speed reducing gear 150. Accordingly, rotation of the motor 82 is first transmitted to the round shaft 94 by the spur gear 134 so that the round shaft 94 is rotated a predetermined number of rotations based upon a predetermined speed reducing ratio. The rotation of the round shaft 94 rotates the dummy cam 140 and spur gear 146. However, since the spur gear 136 and complete cam 138 and the spur gear 144 and complete cam 142 are loosely fitted on the round shaft 94, they are not rotated. Rotation of the round shaft 92 is transmitted from the spur gear 146 to the spur gear 132. The round shaft 92 is rotated a number of rotations determined by a ratio of the number of teeth of the spur gear. The dummy cam 122 fixedly mounted on the shaft 92 is also rotated the same number of rotations. The spur gear 118 on the round shaft 92 is held in meshing contact with the spur gear 136 on the round shaft 94. The spur gear 120 on the round shaft 92 is held in meshing contact with the spur gear 102 on the round shaft 90. The spur gear 128 on the round shaft 92 is held in meshing contact with the spur gear 106 on the round shaft 90. The spur gear 130 on the round shaft 92 is held in meshing contact with the spur gear 144 on the round shaft 94. Therefore, the complete cams 100 and 108 on the round shaft 90 and 138 and 142 on the round shaft 92 will be rotated at a speed based on the ratio of the number of teeth on individual pairs of spur gears. Meanwhile, since the spur gear 132 is held in meshing contact with the spur gear 112, rotation of the round shaft 92 is transmitted to the round shaft 90 to rotate the dummy cams 98 and 110 during a predetermined period while the complete cam 124 is rotated a predetermined number of rotations by way of the spur gear 126 which is held in meshing contact with the spur gear 104. This allows the mole body portions 56 to extend from the circular opening 15 in the housing 10 in various degrees depending on whether a dummy cam or complete cam is contacting the cam contacting portion 74 of the mole body portion 56. Only when the mole body portion 56 is fully extended due to contact with a complete cam, and is struck with the hammer 42 will an effective strike occur.

Figure 6:
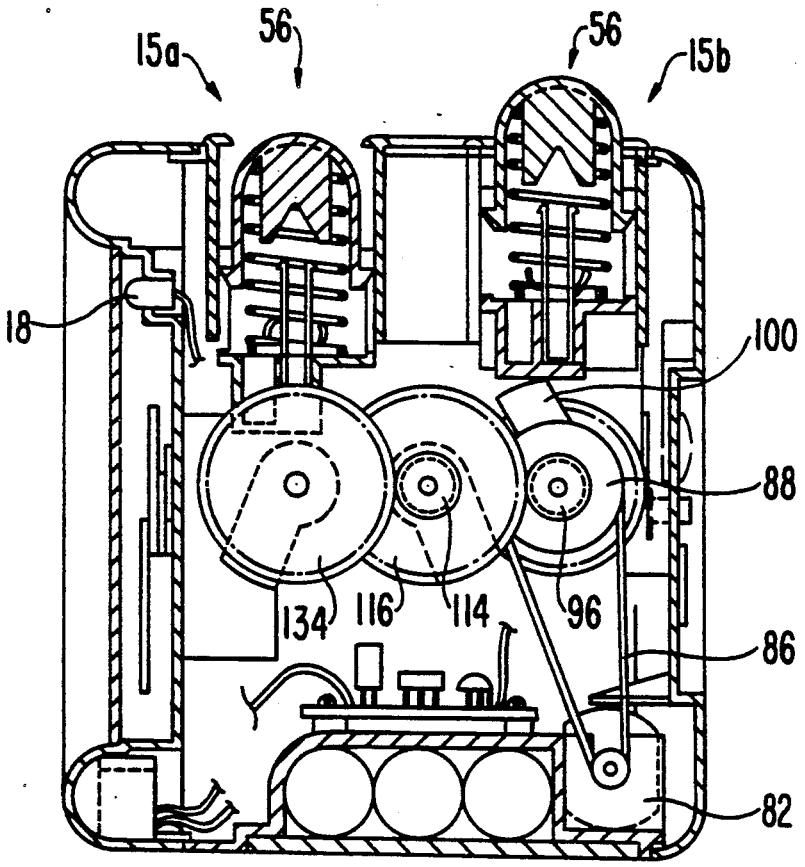
FIG. 6 is a sectional view taken along line I—I of FIG. 1.

FIG. 6 is a sectional view taken along line I—I of FIG. 1 and shows how a mole body portion 56 is moved up and down by a complete cam.

Referring to FIG. 6, the mole body portions 56 are accommodated in the openings 15 for the appearance and disappearance of the moles therethrough. The mole body portions 56 are placed on the complete cams and dummy cams described hereinabove. The mole body portion 56 in a front opening **15*a* is positioned at the lowermost position of the cam while the mole body portion 56 in a rear opening 15*b*** is positioned at an uppermost point.

Figure 8:
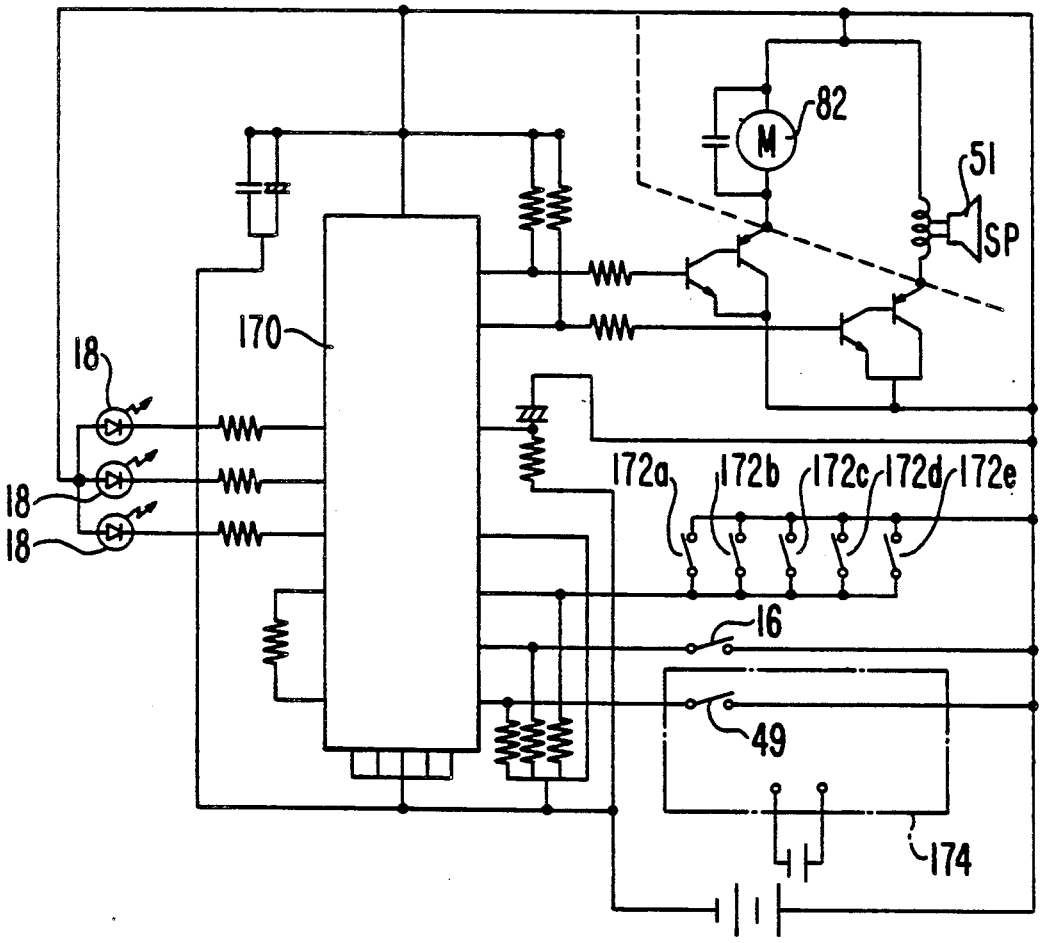
FIG. 8 is a circuit diagram of the alarm clock according to the present invention.

FIG. 8 is a circuit diagram of a mole movement and striking circuit which includes a clock function according to the present invention. In FIG. 8, reference numeral 170 denotes a controlling microcomputer. The controlling microcomputer 170 generates predetermined controlling signals to the individual elements and includes in the inside thereof a counter circuit for counting the number of times an effective strike has occurred. Reference numeral 18 denotes effective strike indicating LEDs which indicate the number of times a mole body portion 56 has been effectively struck. Individual switches are denoted by reference numerals **172*a*–172*e* and exhibit conducting or isolating conditions depending upon contact between the contact pieces 66*a* and 66*b* described hereinabove. Reference numeral 82 denotes a driving motor for the mole movement and striking circuit. Reference numeral 51 denotes a speaker which generates a sound effect such as, for example, "pi", when a mole body portion 56 is struck. Reference numeral 16 denotes a demonstration switch, by which a mole striking game can be played irrespective of an alarm time of the clock. Reference numeral 34, as noted with respect to FIG. 1, denotes a clock unit having an alarm mechanism. A time at which an alarm is to sound can be set by setting a starting time timer. It is noted that the alarm mechanism can be controlled to generate or stop an alarm sound in response to a signal from the controlling microcomputer 170. A signal from the controlling microcomputer 170 can be disconnected by turning the clock alarm switch 49** off. The disconnected condition is a condition wherein the alarm mechanism is not set.

Operation of the present invention will now be described with reference to FIG. 8. First, an alarm time is set by operating the alarm time setting shaft 38 (FIG. 2) of the alarm clock of the present invention. When the set time arrives according to the starting time timer, the controlling microcomputer 170 drives the driving motor 82 which drives the cam mechanisms of FIG. 5 and the alarm mechanism for generating an alarm sound and also drives the speaker 51 for generating a sound effect.

A person who has been asleep is awakened by the alarm sound and will begin to strike the mole body portions 56 using the hammer 42 inserted in the holder 44 in order to stop the alarm mechanism from generating the alarm. When the mole body portions 56 are effectively struck and the counter circuit in the controlling microcomputer 170 reaches a predetermined count number (three, for example, in FIG. 8), the controlling microcomputer 170 causes the driving motor 82 and the alarm mechanism to stop. Since the alarming sound continues to sound until the mole body portions 56 are struck a predetermined number of times (for example, three times) by performing a processing operation as described above, a person will be awakened by the alarm sound. In the meantime, if it is intended to stop generation of the alarm sound from the alarm clock, it is necessary to strike the mole body portions 56 the predetermined number of times (for example, three times) whether the person likes it or not. The mole body portions 56 must be struck at precise timings or an effective strike will not be registered. Consequently, a person will be awakened with certainty. The time indicating section 13 in the embodiment described above is spaced in a horizontal direction away from the mole striking section 14 so that an impact upon striking is not transmitted readily to the time indicating section 13.

The embodiment described above employs an analog clock. A digital clock which employs a liquid crystal display, however, may be employed. In addition, when a function of a stop watch is added to the time indicating section 13 so that the alarm clock is used not as an alarm clock but as a game machine, it may be constructed such that the device can count how many times effective mole striking is performed within a fixed period of time. In this instance, if a digital clock is used, the remaining time can be conveniently indicated in a down counting manner.

The means for detecting whether a mole head 58 projected from an opening is effectively struck is provided by dividing the mole body portion 56 into the mole head 58 and follower body 72 and causing the two contact pieces *66a* and *66b* to be connected to each other by the V-shaped groove 61. The present invention is not limited to this construction, and it is possible to use various other mechanical or electrical means and methods.

As described above, according to an alarm clock of the present invention, since a mole or other object must be struck a predetermined number of times at an effective timing in order to stop an alarm sound, a person cannot stop the alarm sound when the person is half asleep. As a result, the person is awakened by the alarm without fail. Further, the alarm clock comprises a clock which looks interesting in that a plurality of striking objects project their heads at different timings from openings. A mole striking game can also be played with a simple and inexpensive mechanism.

The present invention is not limited to the embodiment described above. Various changes and modifications can be made thereto without departing from the spirit and scope of the invention as set forth in the accompanying claims. That is, for example, in the embodiment described above, a striking object is described by way of example as a mole. It is apparent that some other animal, object or the like other than a mole can be used. In addition, the arrangement and construction of the spur gears or cams is not limited to the construction shown in FIG. 5 in which the mechanism comprises round shafts, complete cams and dummy cams as the cam mechanism means for moving the plurality of mole body portions 56 to appear and disappear through the openings at predetermined timings.

What is claimed is:

1. An alarm clock including a housing for housing timer means for setting an alarm time and alarm sound generating means for generating an alarm sound to notify arrival of the alarm time, comprising:

striking objects mounted in the alarm clock housing for appearing and disappearing out of and into the housing through openings therein;

cam mechanism means for causing said striking objects to appear and disappear;

effective strike detecting means for detecting whether one of said striking objects projected from one of the openings has been struck at a particular timing;

counting means for counting a number of times said striking objects are struck at particular timings; and controlling means for driving said cam mechanism means and the alarming sound generating means when the alarm time set by the timer means is met and for stopping said cam mechanism means and the alarm sound generating means when said counting means reaches a predetermined count.

2. An alarm clock according to claim 1, further comprising switching means for switching said controlling means ON without the setting alarm time being met.

3. An alarm clock/game, comprising:

a housing including top and side portions;

a clock unit enclosed in said housing including alarm setting means for setting an alarm time;

alarm sound generating means for sounding an alarm when the alarm time occurs;

openings formed in the top portion of said housing;

striking objects located within said openings in said housing;

striking means for striking said striking objects;

holder means for holding said striking means for striking said striking objects; and switching means for switching on said striking objects to move in and out of said openings, regardless of said alarm setting means.

4. An alarm clock/game according to claim 3, further comprising:

cam means for controlling the movement of said striking objects;

effective strike detecting means for detecting whether one of said striking objects projected from said openings has been struck;

counting means for counting the number of times said striking objects are struck; and display means for displaying the occurrence of the number of times said striking objects have been struck.

5. An alarm clock/game according to claim 4, wherein the interior of said housing includes controlling means for driving said cam means and said alarm sound generating means and for stopping said cam means and said alarm sound generating means when said counting means reaches a predetermined count.

6. An alarm clock/game according to claim 5, wherein said striking objects comprise:

a follower body;

a cam contact portion attached to said follower body for contacting said cam means;

metal contact pieces inserted in said follower body and including a fixing member;

elastic means inserted inside said contact pieces and over said fixing member; and a hollow head portion placed over said elastic means, said hollow head portion including:

a projection plate located in an interior of said hollow head portion; and resilient engaging projections located on an exterior of said hollow head portion.

7. An alarm clock/game according to claim 6, wherein said cam mechanism comprises:

a motor;

pulley means, operatively connected to said motor, for imparting a motor speed from said motor;

shaft means attached to said side portions of said housing and to said pulley means for driving said shaft means;

spur gears inserted on said shaft means;

dummy cams inserted on said shaft means next to said spur gears; and complete cams inserted on said shaft means next to said spur gears, said spur gears being operatively connected to said pulley means for moving said striking objects in and out of said openings in said housing.

8. An alarm clock/game according to claim 4, further comprising:

a microprocessor located within said housing;

strike number indicating means, connected to said microprocessor, for indicating that one of said striking objects has been effectively struck; and speaker means, operatively connected to said motor and said microprocessor, for emitting a sound when the alarm setting time occurs and each time one of said striking objects has been effectively struck.

* * * * *